United States Patent [19]

Bowyer et al.

[11] 4,446,922

[45] May 8, 1984

[54] ADJUSTABLE SAFETY VALVE

[75] Inventors: Michael L. Bowyer; Drummond Whiteford, both of Aberdeen, Scotland

[73] Assignee: Baker Oil Tools, Inc., Orange, Calif.

[21] Appl. No.: 388,846

[22] Filed: Jun. 16, 1982

[51] Int. Cl.[3] ..... E21B 34/10

[52] U.S. Cl. ..... 166/322; 166/386; 166/332

[58] Field of Search ..... 166/319, 321, 322, 332, 166/374, 375, 386; 251/63.4, 352

[56] References Cited

U.S. PATENT DOCUMENTS

| | | | |
|---|---|---|---|
| 4,036,296 | 7/1977 | Mott et al. | 166/322 |
| 4,284,141 | 8/1981 | Mott | 166/322 |
| 4,289,205 | 9/1981 | Mott | 166/377 |
| 4,361,188 | 11/1982 | Russell | 166/374 |
| 4,368,871 | 1/1983 | Young | 251/63.4 |

FOREIGN PATENT DOCUMENTS

| | | | |
|---|---|---|---|
| 2263036 | 7/1973 | Fed. Rep. of Germany | 166/321 |

*Primary Examiner*—Stephen J. Novosad
*Assistant Examiner*—William P. Neuder
*Attorney, Agent, or Firm*—Norvell & Associates

[57] ABSTRACT

A ball type safety valve mounted in a movable cage for automatically closing a subterranean well conduit is disclosed. The ball has a central flow passage which can be aligned with the tubing to permit production and can be automatically rotated to block the tubing. The ball is moved from its closed to its open position by an increase in control fluid pressure, preferably in an external control fluid line extending to the surface of the well. An increase in control fluid pressure causes the cage to move axially and rotation is imparted by the offset camming means attached to a stationary base member. The base member is adjustable relative to the valve housing and to the cage to insure that the valve is fully open and fully closed at opposite extremes of the travel of the cage and ball assembly.

16 Claims, 3 Drawing Figures

ADJUSTABLE SAFETY VALVE

BACKGROUND OF THE INVENTION

1. Field of the Invention:

This invention relates to a ball type safety valve used in a subterranean oil or gas well for automatically closing the well in response to a change in control fluid pressure.

2. Description of the Prior Art:

The most common types of downhole safety valve for automatically closing a subterranean fluid production conduit such as a tubing string extending within the casing of a producing oil or gas well are ball type or flapper type valves. Ball type valves employ a rotatable ball valve member which has a flow passage extending through the spherical ball element. The flow passage can be aligned with the tubing string to permit flow through the well. Rotation of the ball about a transverse axis through an angle of 90° will close the tubing since valve seats and seals located above and below the valve will continuously circumferentially seal along a path on the exterior of the ball element. These ball type safety valves have a full opening and permit full flow through the tubing and through the valve itself.

Ball type safety valves may be used as either wireline safety valves in which a lock assembly is used to secure the safety valve in a nipple incorporated into the tubing string or as safety valves incorporated directly into the tubing string. In either case rotary actuation of the ball valve conventionally occurs as a result of axial movement of the ball valve element. A camming means normally comprising a separate pin engaging a milled slot in the exterior of the ball offset from the primary rotation pins is generally fixed relative to the moving ball. As the ball moves from a first to a second axial position the rotation pin moves relative to the cam pin and the ball is rotated from the closed position to the open position through an angle of 90°. Conventional ball valve elements require movement of the ball away from the valve seats during rotation of the ball itself. This prevents damage to elastomeric seals positioned on the ball valve seats. Longitudinal movement of the ball valve element is generally imparted by longitudinal movement of a flow tube having a surface exposed to control fluid pressure. In general this flow tube will be spring-loaded such that a decrease in control fluid pressure acting on the flow tube will urge the flow tube upward thus permitting movement of the ball valve from the open to the closed position and automatically closing the tubing.

U.S. Pat. No. 4,289,205 shows one ball type safety valve in which the ball is positioned on a support member and positioned within an axially movable cage. During actuation of this ball the ball first moves away from the upper seat member to permit rotation. Rotation of the ball occurs upon axial movement of the ball support member and the ball relative to the cage. This rotation occurs due to the presence of an offset camming pin interconnecting the ball and the cage and permitting rotation about a transverse axis.

SUMMARY OF THE INVENTION

A safety valve for automatically closing a fluid transmission conduit such as a tubing string in a subterranean oil or gas well consists of an outer valve housing, a valve cage, a ball valve element and a valve base. The valve element is mounted in the valve cage and a change in the pressure differential between control fluid pressure and well fluid pressure imparts axial movement to both the cage and the ball element. The ball rotates relative to the cage about a transverse axis as a camming pin attached to the valve base and offset from the axis of rotation of the ball moves longitudinally relative to the ball and cage assembly. The valve base is adjustably shiftable relative to the valve housing and to the valve cage to precisely orient the initial and final position of the camming pin relative to the rotation pin. This adjustment insures that the ball valve with its central flow passage is fully closed in a first position and is fully open upon axial movement of the cage and ball to a second position. The ball element is insertable into the central portion of the one-piece cage assembly and rotation pins can then be inserted through axially extending arms in the cage assembly to engage the ball element along milled flats on opposite sides of the generally spherical ball valve element.

The preferred embodiment of this invention comprises a wireline retrievable subsurface safety valve in which control fluid pressure communicates with a surface on an axially extending flow tube in the valve itself. The flow tube is normally spring biased to an upward position. An increase in control fluid pressure normally through an external control line extending between the valve and the surface causes axial movement of the flow tube member against the action of the spring. The flow tube member is attached to the valve cage and imparts axial movements to the valve cage and the ball valve element.

DESCRIPTION OF THE PREFERRED EMBODIMENT

Figure 1A:
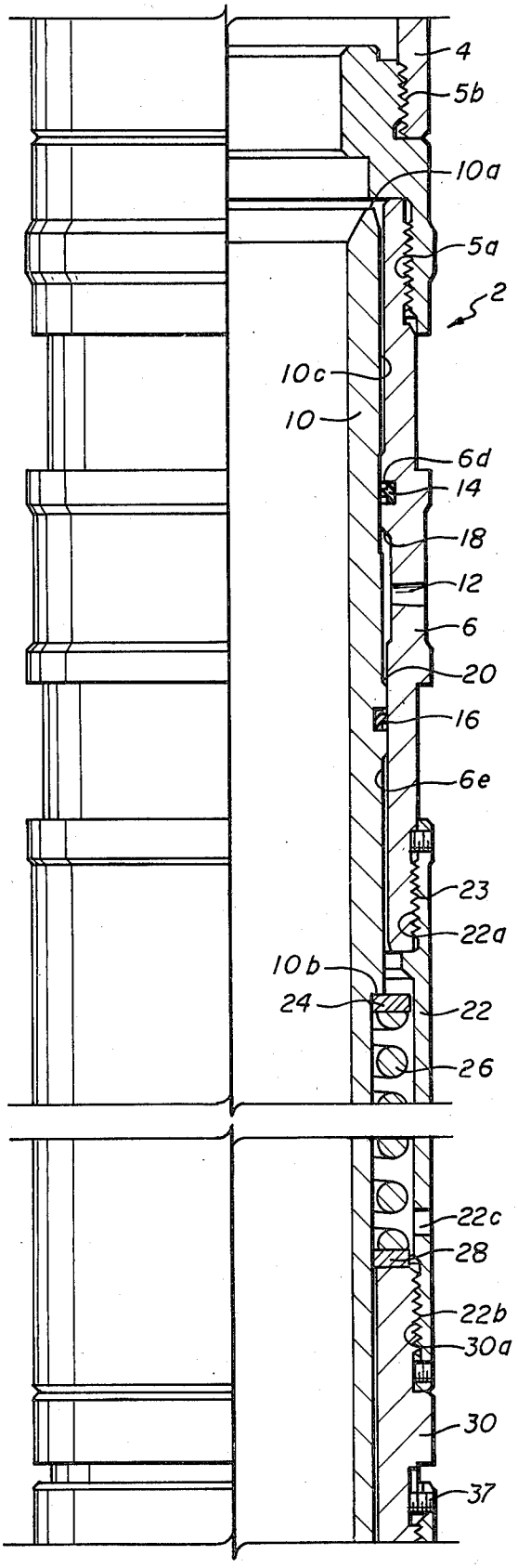
FIGS. 1A and 1B are longitudinal continuations of a quarter-section view illustrating a wireline retrievable non-equalizing ball valve.

Non-equalizing ball type valve 2 comprises the preferred embodiment of this invention. The non-equalizing ball valve 2 depicted herein is used as a surface controlled subsurface safety valve. Valve 2 can be positioned within the tubing string in a well by use of a conventional lock assembly 4 attached on the upper end of the valve assembly. Lock 4 has conventional locking dogs for engaging a standard nipple groove in a conventional landing nipple incorporated into the tubing string. Conventionally control fluid communication is established through an external control line (not shown) attached to the safety valve landing nipple and extending from the nipple to the surface of the well. Increased control fluid pressure within the external control fluid line will actuate the safety valve to hold the valve in the open position. Damage to the external control fluid line as a result of damage to the wellhead will cause the safety valve to close thus preventing production of well fluids through the safety valve and through the tubing. The conventional lock, landing nipple and external control fluid line do not comprise essential elements of this invention and are not therefore depicted in detail.

Safety valve 2 generally comprises an outer housing assembly, a flow tube 10 and a rotatable ball valve element or head 50. Downward movement of the flow tube 10 under the action of control fluid pressure results in a rotation of ball valve head 50 to align the internal passage extending through ball valve head 50 with the flow tube and with the internal bore of the tubing string thus permitting production through the tubing. Upward movement of flow tube 10 relative to the valve housing from the open position results in relative rotation of the ball valve head 50 to again close the flow tube passage.

The upper valve housing of safety valve 2 comprises a ported housing member with a cross-over sub member 5 engaging the ported sub by means of cooperating threaded connections 5*a* and 6*a*. Cross-over member 5 in turn has threaded connection 5*b* permitting interconnection between the valve assembly 2 and conventional lock 4. Port housing 6 has a radially extending port 12 for establishing communication between the external control fluid line attached to a conventional landing nipple (not shown) and the reciprocal flow tube 10 located on the interior of the valve housing. Ported housing 6 has an annular seal retaining cavity 6*d* located above port 12. A conventional dynamic T-seal 14 is positioned within cavity 6*d* and provides sealing integrity between flow tube 10 and port housing 6 above port 12. An internal seal bore surface 6*e* extends below port 12.

Port housing 6 is attached to outer housing sleeve 22 by means of threaded connection 6*c* and 22*a* at the lower end of port housing 6. Outer housing sleeve 22 comprises a cylindrical member defining a portion of a cavity in which helical power spring 26 is located. Outer housing sleeve 22 has threads 22*b* located at its lower end for engaging the mating threads 30*a* on spring support housing 30 located below sleeve 22. A port 22*c* provides communication between the cavity containing power spring 26 and the annular gap between the valve housing 2 and the tubing nipple assembly (not shown).

Spring support housing 30 has an upwardly facing shoulder 30*b* defining the lower portion of the cavity containing helical power spring 26. Spring bushings 24 and 28 are located on opposite ends of the power spring assembly. Lower bushing 28 engages the upwardly facing surface 30*b* on the spring support housing. The upper end of the power spring engages upper bushing 24 which in turn engages a downwardly facing surface 10*b* on the flow tube. A downwardly facing shoulder 30*d* is located immediately below threads 30*c* which engage threads 38*a* on an external adjustment sleeve 38 extending on the external of the valve below spring support housing 30. Adjustment sleeve 38 comprises an elongate cylindrical member. The lower end of adjustment sleeve 38 is enlarged and has an upwardly facing abutment surface 38*b*. A bottom sub 66 is located immediately below adjustment sleeve 38 but neither is directly interconnected. Bottom sub 66 is attached by means of a threaded connection to base member 58. Base member 58 has a downwardly facing surface 58*a* which engages the upwardly facing surface 38*b* on the adjustment sleeve. Base 58 thus interconnects the adjustment sleeve 38 and bottom sub 66.

Flow tube 10 is reciprocal within the outer housing assembly which comprises ported nipple 6, outer housing sleeve 22, spring support housing 30, adjustment sleeve 38, and the bottom sub 66. Flow tube 10 is a longitudinal cylindrical member having an upper end face 10*a* above a seal bore surface 10*c* on the exterior of flow tube 10. An annular seal cavity 10*d* is located below seal bore 10*c* on the exterior of the flow tube for seat of a conventional dynamic elastomeric T-seal 16. Seal 16 is similar to seal 14. Seal 14 provides sealing integrity between the port housing 6 and the seal bore surface above port 12 while seal 16 provides sealing integrity between flow tube 10 and seal bore surface 6*e* below port 12. A pressure chamber is defined between seals 14 and 16 and the control fluid pressure will act on a downwardly facing surface 20 at the base of this pressure chamber and extending annularly around the flow tube 10. The differential pressure acting on this downwardly facing surface between the seals 14 and 16 will result in an unbalanced pressure force acting on flow tube 10 to cause downward movement of the flow tube.

The lower portion of flow tube 10 defines the inner portion of the cavity containing helical power spring 26. A downwardly facing surface 10*b* on flow tube 10 is positioned immediately above the power spring 26. Spring 26 acts on bushing 24 which in turn acts on downwardly facing surface 10*b* to transfer the spring load to the flow tube 10. Thus spring 26 acts to move flow tube 10 in the upward direction. An annular recess 10*f* is located on the extreme lower end of the flow tube immediately above downwardly facing end face 10*g*. The annular groove 10*f* is dimensioned for seat of a circular split of C-ring 34. Flow tube 10 thus extends on the interior of the port housing 6, the outer housing sleeve 22, and the spring support housing 30. The upper end of adjustment sleeve 38 overlaps the lower end of the flow tube 10.

Split ring 34 interconnects flow tube 10 with a cage assembly comprising a cage bushing 32, main cage member 44, and upper and lower valve seats 40 and 54 respectively. Cage bushing 32 and upper valve seat 40 are located on opposite ends of split ring 34 and extends circumferentially around the lower end of flow tube 10. A threaded connection 42 interconnects cage bushing 32 with the main cage member 44. An outer downwardly facing surface 40*b* on the upper valve seat engages a cooperable upwardly facing surface on cage 44. Thus valve seat 40 is trapped relative to cage 44 and cage bushing 32 is interconnected to cage 44. By positioning the split ring between these two fixed members, flow tube 10 is in turn interconnected with cage bushing 32, upper valve seat 40 and the main cage member 44. Movement of flow tube 10 will thus result in movement of main cage member 44. Cage 44 comprises a one-piece member having a pair of downwardly extending arms 45 connecting upper and lower cylindrical sections. Lower valve seat 54 is spring-loaded relative to cage 44 by means of a helical spring trapped between a downwardly facing surface 54*b* on the valve seat and an upwardly facing surface 44*c* on the main cage member. A downwardly facing surface 44*a* on the exterior or the main cage member defines a step between the upper portion of cage member 44 including cage arms 45 and a lower extension of the cage member. This lower extension is defined by an outwardly facing cylindrical surface 44*b* immediately above the lower end face 44*d* of the main cage member. Finally a slightly elongated pivot pin hole 48 extends through each pivot arm 45 of main cage member 44. Holes 48 are aligned for receipt of pivot pins 46 for positioning ball valve head 50 within the cage assembly 44.

Ball valve head 50 is spherical and has an axially alignable flow passage extending completely through the ball valve head in the conventional manner. The ball valve head can be aligned with the pivot pins holes located in arms 45 on cage 44. Ball 50 has a pin receiving hole which can be properly aligned to receive the tip of pin 46. Ball 60 can be inserted through the side of the one-piece cage housing between opposed cage arms 45. Pin 46 can then be inserted through holes 48 into engagement with the exterior of the ball head 50. Ball 50 has a planer surface 55 on opposed sides adjacent cage arms 45 to permit rotation of the ball relative to cage arms 45. On at least one side of ball 50 an elongated slot 62 is located on the surface of the ball. Slot 62 may be located along planer surface 54 or immediately adjacent thereto. Oblong slot 62 is deep enough to receive the end of an offset cam pin 52 attached to an upstanding arm 60 extending upwardly from base 58.

Base 58 is a generally cylindrical member attached through bottom sub 66 to outer adjustable sleeve 38. Base arm 60 is located adjacent to cage arm 45 on at least one side of ball head 50. Base arm 60 is axially reciprocal relative to cage 44 and cage arm 45. Cam pin 52 can thus be moved within slot 62 relative to pivot pin 46 thus permitting 90° rotation for ball 50.

OPERATION

Valve assembly 2 is controlled from the surface by control fluid communicating through port 12 and acting upon a differential area located on the exterior of flow tube 10. An increase in control fluid pressure acting on flow tube 10 will cause downward movement of flow tube 10. Interconnection between the lower end of flow tube 10 and upper valve seat 40 is maintained through cage bushing and main cage member 44 as previously described. Ball valve element 50 is mounted on main cage member 44 by means of pivot pin 46. However pivot pin 46 rests within an elongated hole 48 in cage arm 45 of main cage member 44. Therefore the ball element is not preloaded relative to pin 46 which can move axially within hole 48. There is however a preload between valve seat 40 and the valve seat surface 46 and the exterior of the spherical ball valve head 50. In turn there is preload between the flow tube member 10 and ball element 50 through the valve seat 40. Downward movement of flow tube 10 is transferred to the ball through valve seat 40 and to the main cage member 44 as previously described. The entire cage and ball assembly will thus move downward relative to the outer housing, consisting in part of adjustment sleeve 38 and spring support housing 30 and outer housing sleeve 22, when the flow tube is subjected to an increase in control fluid pressure. The cage 44 and ball 50 will also move downward relative to base 58 and upstanding base arm 60. Thus there will be relative axial movement between pivot pin 48 and cam pin 52. This relative movement will cause rotation of ball head 50 about pivot pin 46. Thus movement will continue until the lower face **44*d* abuts a cooperable upwardly facing surface on base 58. Full axial travel of cage 44 and ball valve head 50 should result in a 90° rotation of the ball valve head and its fluid transmission passage extending therethrough from the closed position of FIG. 1 to the open position of FIG. 2**.

Figure 1B:
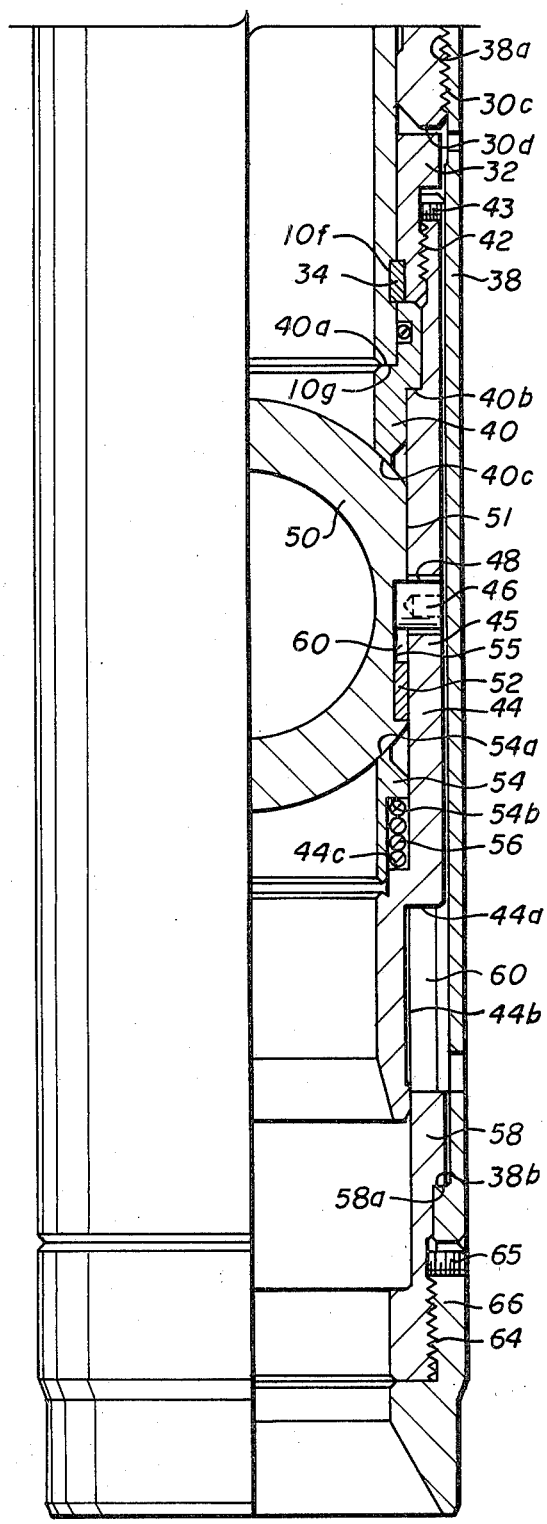
Figure 2:
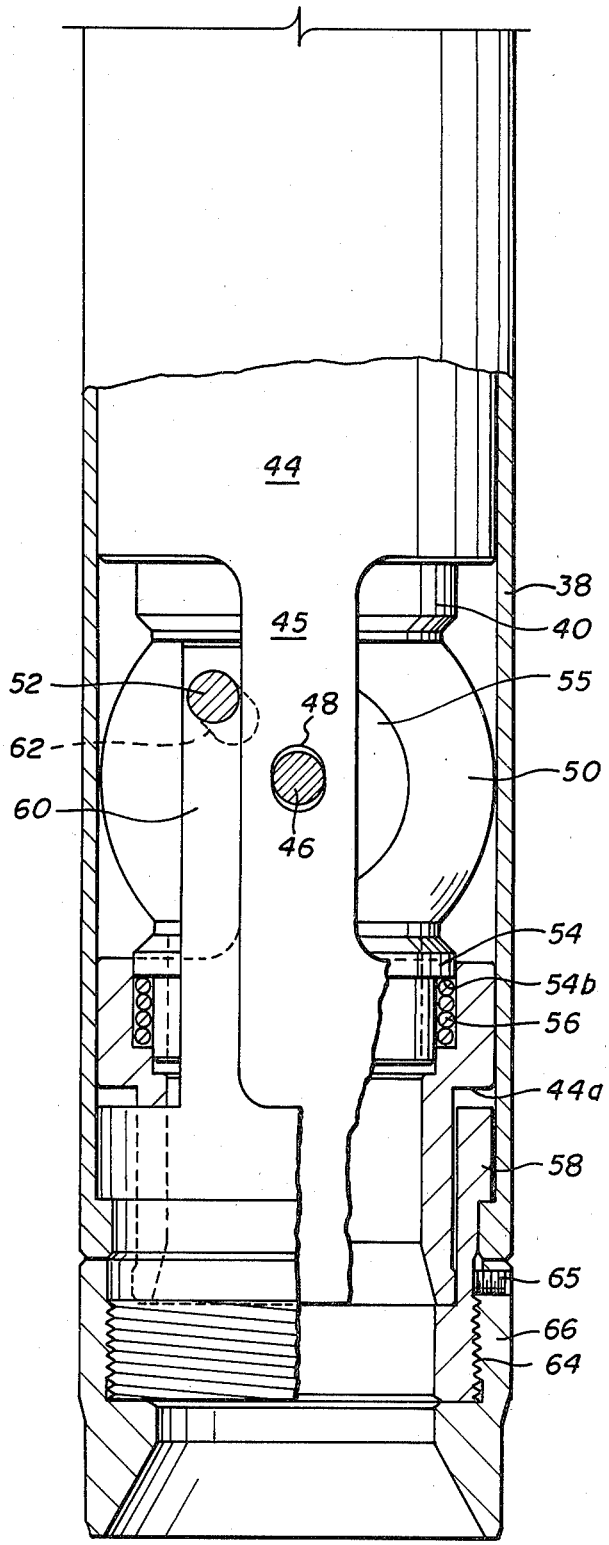
FIG. 2 is a view showing that portion of the ball valve generally shown in FIG. 1B with the ball valve in the open position.

Although ball head 50 would ideally be in the fully closed position in FIG. 1B and in the fully open position in FIG. 2 it is possible that during assembly of the ball it may be in a cocked, partially closed, partially open position at one extent of its travel. The position of ball head 50 can be adjusted to insure that the ball will be fully closed at the upper extent of its travel represented in FIG. 1B and fully open at the lower extent of the ball cage travel represented by FIG. 2. To adjust the orientation of ball head 50 the adjustment sleeve 38 may be axially shifted by changing the extent of threaded engagement at **38*a* and 30*c*. This axial movement of sleeve 38 will in turn axially shift base 58 and base arm 60 relative to cage 44. Thus slight adjustments in the rotational orientation of the ball head 50 can be made by axially repositioning the adjustment sleeve 38. When sleeve 38 has been positioned at the appropriate point set screw 37 can be engaged to permit further movement of the adjustment sleeve. The ball head 50 will then be in position to be fully closed between upper valve seat 40 and lower valve seat 54, each of which are in continuous engagement with the exterior of the ball valve head, at the full upward extent of the travel of cage 44 and ball head 50. In turn when the ball valve head 50 and cage 44 are at the lowermost extent of their axial travel, as represented in FIG. 2**, it is fully open.

Although the invention has been described in terms of the specified embodiment which is set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A safety valve for automatically closing a fluid transmission conduit in a subterranean well in response to a change in the pressure differential between a control fluid pressure and the well fluid pressure below the valve, comprising:

a valve housing;

a valve cage axially reciprocal relative to the valve housing between a first position and a second position in response to an increase in control fluid pressure;

a ball valve element having a flow passage extending therethrough mounted in the valve cage and axially movable with the valve cage and rotatable from the closed to the open positions relative to the valve cage upon movement of the valve cage between the first and second positions respectively;

a valve base shiftable relative to the valve cage and the valve housing to define the first and second positions relative to the valve housing, the valve cage and the ball member being movable relative to the valve base; and camming means interconnecting the valve base and the ball valve element to impart rotation to the ball valve element upon axial movement of the valve cage and ball valve element relative to the valve base, so that by shifting the valve base and the camming means relative to the valve housing, the ball valve element can be adjusted so that the ball valve element flow passage is fully aligned with the fluid transmission conduit in the second position and perpendicular thereto in the first position.

2. The safety valve of claim 1 further comprising a cylindrical flow tube attached to the valve cage, control fluid pressure acting on a surface of the flow tube whereby an increase in control fluid pressure axially shifts the flow tube and the valve cage relative to the valve housing.

3. The safety valve of claim 2 wherein the flow tube is spring biased relative to the valve housing.

4. The safety valve of claim 1 further comprising upper and lower valve seats in constant circumferential contact with the ball valve element.

5. The safety valve of claim 4 further comprising a flow tube, the upper valve seat being attached between the flow tube and the ball valve element.

6. The safety valve of claim 5 wherein the lower valve seat is spring loaded between the ball valve element and the valve cage.

7. The safety valve of claim 1 wherein the valve cage abuts an opposed surface of the valve base when the valve cage is in the second position.

8. The safety valve of claim 1 wherein the camming means comprises a camming pin attached to the valve base, received within an elongated camming slot on the surface of the ball valve element and offset relative to a rotational pin interconnecting the ball valve element and the valve cage.

9. The safety valve of claim 1 wherein the valve cage member extends above and below the ball valve element.

10. The safety valve of claim 1 wherein said valve cage comprises a single member.

11. A safety valve for automatically closing a fluid transmission conduit in a subterranean well in response to a change in the pressure differential between a control fluid pressure and the well pressure below the valve, comprising:

a valve cage axially reciprocal between a first position and a second position in response to an increase in control fluid pressure and comprising a unitary member having tubular upper and lower sections on opposite sides of an opening in the side of the cage;

a ball valve element having a flow passage therethrough, the ball valve element being insertable through the cage opening;

pivot means for attaching the ball valve element to the cage to permit rotation of the ball valve element in the cage about a transverse pivot axis from a closed to an open position; and a base member movable relative to the cage and having an axially extending member engaging the ball valve element at a point offset from the pivot axis to impart rotation of the ball valve element upon movement of the cage from the first to the second position.

12. The safety valve of claim 11 wherein said base member is axially adjustable relative to the cage to define the first and second positions.

13. The safety valve of claim 12 further comprising upper and lower valve seats in the cage in continuous circumferential contact with the ball valve element.

14. The safety valve of claim 13 wherein one of said upper and lower valve seats is spring loaded between the cage and the ball valve element.

15. The safety valve of claim 14 further comprising a flow tube attached to the cage and having a surface exposed to control fluid pressure and abutting the upper valve seat to impart movement of the cage from the first to the second position in response to an increase in control fluid pressure.

16. The safety valve of claims 11, 12, 13, 14 or 15 wherein the ball valve element moves axially with the cage from the first to the second position during rotation from the closed to the open position.

* * * * *